US007409774B2

(12) United States Patent
Luling

(10) Patent No.: US 7,409,774 B2
(45) Date of Patent: Aug. 12, 2008

(54) BOREHOLE TOOL

(75) Inventor: Martin Luling, Paris (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 209 days.

(21) Appl. No.: 10/598,941

(22) PCT Filed: Feb. 8, 2005

(86) PCT No.: PCT/EP2005/001436

§ 371 (c)(1),
(2), (4) Date: Sep. 15, 2006

(87) PCT Pub. No.: WO2005/090752

PCT Pub. Date: Sep. 29, 2005

(65) Prior Publication Data

US 2007/0193776 A1 Aug. 23, 2007

(30) Foreign Application Priority Data

Mar. 18, 2004 (EP) ..... 04290744

(51) Int. Cl.
*E21B 47/08* (2006.01)

(52) U.S. Cl. ..... 33/544.2; 33/544; 73/152.17

(58) Field of Classification Search ..... 33/302, 33/542, 543, 544, 544.1, 544.2, 544.3, 555.1; 73/152.17; 250/268; 324/367, 374
See application file for complete search history.

(56) References Cited

U.S. PATENT DOCUMENTS

| | | | | |
|---|---|---|---|---|
| 2,267,110 | A * | 12/1941 | Kinley et al. | 33/544.2 |
| 2,899,633 | A * | 8/1959 | Smith et al. | 324/347 |
| 3,254,221 | A * | 5/1966 | Saurenman | 250/268 |
| 3,555,689 | A * | 1/1971 | Cubberly, Jr. | 33/544.3 |
| 4,121,345 | A * | 10/1978 | Roesner | 33/544.2 |
| 4,468,623 | A | 8/1984 | Gianzero et al. | |
| 4,614,250 | A | 9/1986 | Panetta et al. | |
| 4,692,707 | A | 9/1987 | Locke et al. | |
| 4,862,090 | A | 8/1989 | Vannier et al. | |
| 5,502,686 | A | 3/1996 | Dory et al. | |
| 5,631,562 | A | 5/1997 | Cram et al. | |
| 6,378,627 | B1 * | 4/2002 | Tubel et al. | 175/24 |
| 2003/0164706 | A1 | 9/2003 | Iwanicki et al. | |

FOREIGN PATENT DOCUMENTS

| | | |
|---|---|---|
| EP | 0285473 | 5/1988 |
| WO | WO02101194 | 12/2002 |

* cited by examiner

*Primary Examiner*—R. A. Smith
(74) *Attorney, Agent, or Firm*—Bryan L. White; James Kurka; Darla Fonseca

(57) ABSTRACT

A borehole tool, comprises: a tool body; a series of arms connected to the tool body and moveable radially relative thereto; and a series of pads mounted on the arms so as to be pivotable about a radial axis relative to the tool body. By allowing pivoting of the pads about a radial axis, elongate pads can be arranged to provide different circumferential coverage according to the orientation with respect to the longitudinal axis of the borehole.

23 Claims, 7 Drawing Sheets

BOREHOLE TOOL

This invention relates to a borehole logging tool such as a borehole pad-imager logging tool comprising a series of radial arms carrying pads that can be pressed against the borehole wall.

In borehole logging, there is a type of tool known as a pad tool in which a pad, typically carrying one or more high-resolution sensors, is mounted on a tool body in such a manner that it can be pressed against the borehole wall. This has the effect of placing the sensor (s) in close proximity to the borehole wall and so allows the high-resolution measurements of the small-scale geometric features in the formation surrounding the borehole to be made. One example of such a high-resolution measurement is a microelectrical measurement that can be used for determining the resistivity of the formation immediately surrounding the borehole, or for producing an image of the formation immediately surrounding the borehole to identify dips, fractures or other morphological features.

One example of a pad tool for making resistivity measurements is found in U.S. Pat. No. 4,692,707. In this tool, a tool body carries a measurement pad mounted on pivoting and articulated links. The pad is urged away from the tool body by a spring so as to be brought into contact with the borehole wall. The links maintain the longitudinal axis of the pad substantially parallel to the tool axis while allowing the pad to tilt in the axial plane so as to accommodate irregularities in the borehole wall.

For dip measurement or imaging applications, pad tools typically comprise a tool body having a series of radial arms carrying a series of pads (for example, four arms carrying four pads, or six arms carrying six pads), which, in use, are arranged around the circumference of the borehole wall. Examples of such tools are found in U.S. Pat. Nos. 4,468,623, 4,614,250, 5,502,686, EP 0 285 473 and US 2003/0164706, and in the Formation Micro-Scanner (FMS), Fullbore Formation MicroImager (FMI) and Oil-Based Mud Imager (OBMI) tools of Schlumberger and the Simultaneous Acoustic and Resistivity (STAR) Imager and Hexagonal Diplog (HDIP) of Baker Atlas. All of these tools comprise fixed-width, fixed orientation pads. Consequently, the total circumferential coverage of the borehole wall by the pads will depend on the diameter of the borehole: the larger the borehole, the less of its circumference that can be covered by the pads. This results in images with gaps between the image tracks from the pads. The pads for these tools are typically mounted on parallel arms attached to the top and the bottom of each pad so as to maintain the longitudinal axis each pad parallel to the tool body and to prevent tilting in the axial plane. The pads described in EP 0 285 473 comprise a pair of flaps that pivot about a longitudinal axis to accommodate variations in the borehole shape.

Highly deviated wells may actually follow some bed boundaries in the formation through which they are drilled and as such provide longitudinally striped images that are difficult to evaluate if the image contains sizeable gaps. For these and other applications a full-borehole coverage for image logs is desirable. Several tools with rotating sensors, such as the Ultrasonic Borehole Imager (UBI) wireline tool of Schlumberger, or the Resistivity At Bit (RAB) and Azimuthal Density Neutron (ADN) logging-while-drilling tools of Schlumberger provide full-coverage images that simplify interpretation especially in highly deviated wells. Imager tools are typically used in holes of varying sizes, possibly with washouts, and in directional wells almost certainly with hole ovalization. Such features can also give problems with existing pad tool designs.

The present invention resides in the realization that providing pads which are allowed to rotate about a radial axis means that the orientation of the pad can be changed to adjust the actual amount of circumferential coverage by that pad and so accommodate different borehole diameters and shapes while providing the same degree of coverage.

The present invention provides a borehole tool, comprising: a tool body; a series of arms connected to the tool body and moveable radially relative thereto; and a series of pads mounted on the arms so as to be pivotable relative thereto; characterized in that the pads are pivotable about a radial axis relative to the tool body.

By allowing pivoting of the pads about a radial axis, elongate pads can be arranged to provide different circumferential coverage according to their orientation with respect to the longitudinal axis of the borehole.

Preferably, the pads are connected to the arms such that the pad orientation relative to the tool body is determined by the extent of the arms in the radial direction. It is preferred that the pad pivoting is synchronized such that the pads adopt a substantially regular pattern of orientation. Such synchronization can be accomplished by interconnection of adjacent pads. One particularly preferred arrangement of pads comprises a ring arrangement with each pad being connected at its ends to the adjacent pads.

The arms can be arranged symmetrically around the tool body. Each arm is preferably connected to the tool body at one end by a pivot or hinge that allows the arm to move in an axial plane relative to the tool body (a plane of constant azimuth where the arm is pivoting in axial-radial directions.). The ends of the arms can be connected to the pads. The arms can move between two limit positions: the first in which the arm lies substantially parallel to the tool body; and the second in which the arm projects away from the tool body in a radial direction to contact the borehole wall, either directly or through the pads.

One particularly preferred arrangement of arms comprises two sets of arms separated along the tool body with the series of pads encircling the body between the sets of arms. In this arrangement, the arms of each set extend from the connection on the tool body towards the other set. There are preferably the same number of arms in each set, the two sets being arranged on the tool body in an angularly offset configuration. For sets of arms having N arms per set, the offset is typically 360°/2N between the arms of the two sets. In such an arrangement, the elongate pads can be connected to the arms in such a way that one end of a pad is connected to an arm from the first set and the other end of the pad is connected to the adjacent arm of the second set. Thus, where there are N arms in each set, there are 2N pads arranged around the tool. In the first limit position of the arms, the pads lie substantially parallel to and alongside the tool body. In the second limit position, the orientation will depend on the distance from the tool body of the pads when they contact the borehole wall. In free space, the limit position is when the pads all lie in a radial plane (i.e. the long axis of each pad lies substantially in the same radial plane) (a plane that is perpendicular to the tool axis where the close pad-chain constitute a circle whose diameter is twice the arm lengths and the inner-tool diameter). In between, the pads form a zigzag array extending around the circumference of the borehole.

Movement of the arms can be achieved in a number of ways. They can be operated by electric or hydraulic actuators, spring biasing arrangements, or the like. Where two sets of arms are provided, one preferred arrangement comprises locating the ends of one set in a fixed position on the tool body and locating the other set on the tool body by means of a sliding ring and driving the sliding ring along the tool body towards or away from the fixed position to cause the arms of both sets to extend or retract. A similar arrangement can be used where a single set of arms is used, the ring being connected to the arms by means of links.

In one embodiment, the arms a securely connected to the ring. In this case, the arms are constrained to open the same amount to give a substantially circular, or regular arrangement. In another embodiment, the arms are connected to the ring so as to be movable axially with respect to the ring, at least to a limited degree. This allows each arm to adopt a different position depending on the hole shape. In both cases, sensors can be provided on the arms to give calliper measurements. In the first case, a conventional hole size measurement can be derived. In the second case, hole size and shape can be derived.

The pads can be connected to the arms in a number of different ways. Each arm can carry one pad, connected either at its end or part way along the pad; each arm can be connected to two pads at adjacent ends, etc. The connection should allow pivoting movement between the pad and arm about three orthogonal axes. In the zigzag arrangement described above, it is preferred that the two pads connected to each arm are interlinked such that they cannot tilt independently of each other in an axial plane.

The pads can comprise a two-dimensional array of sensors, for example electrical, electromagnetic, nuclear or acoustic sensors, distributed on the wall-engaging surface thereof. The wall engaging surface can be curved such that contact between the pad and the borehole wall is optimized for different pad orientations.

The invention will now be described in relation to the drawings, in which.

Figure 1:
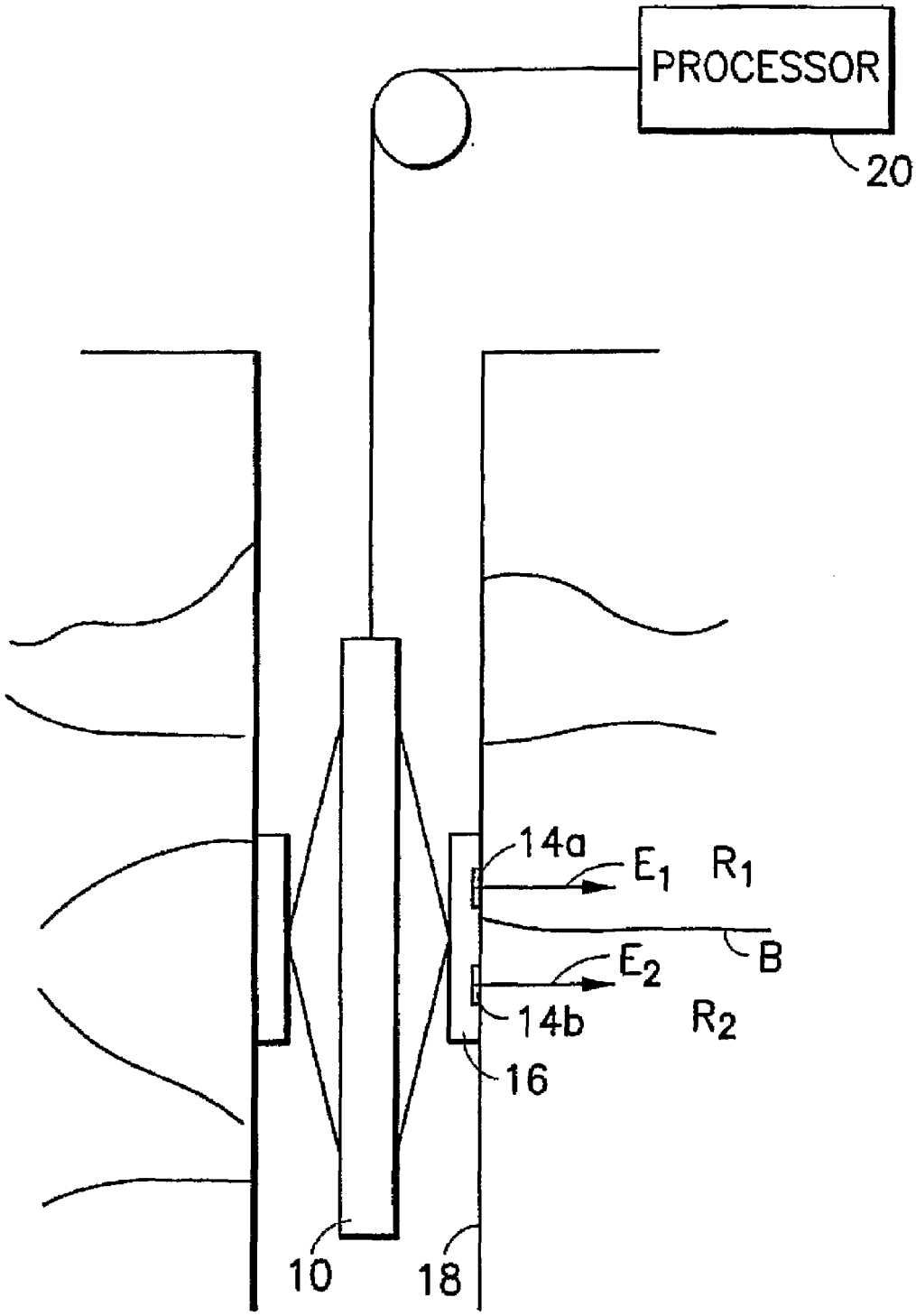
FIG. 1 shows a generic micro-resistivity pad tool.
Figure 2:
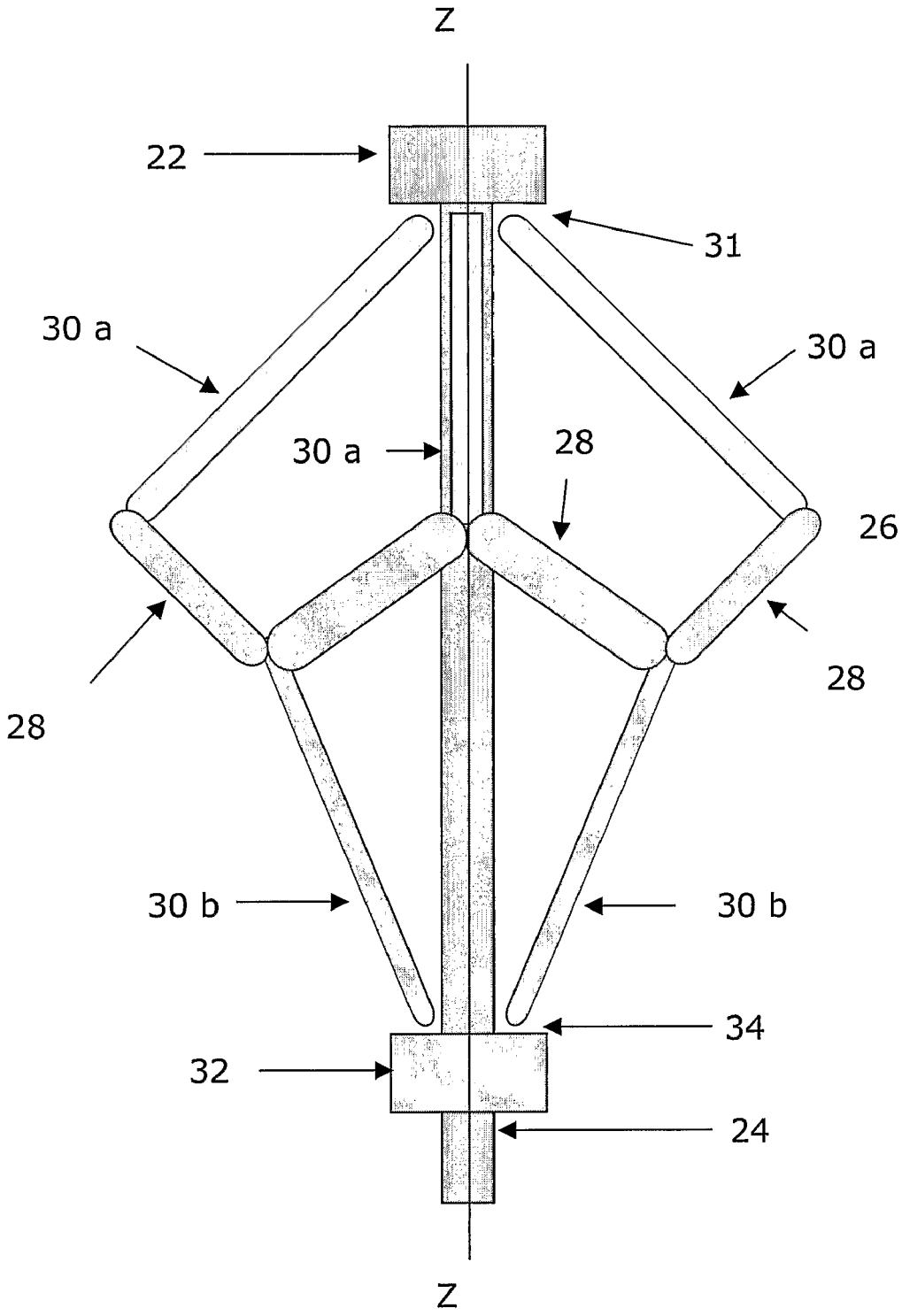
FIG. 2 shows a schematic side view of a pad tool according to an embodiment of the invention.
Figure 3:
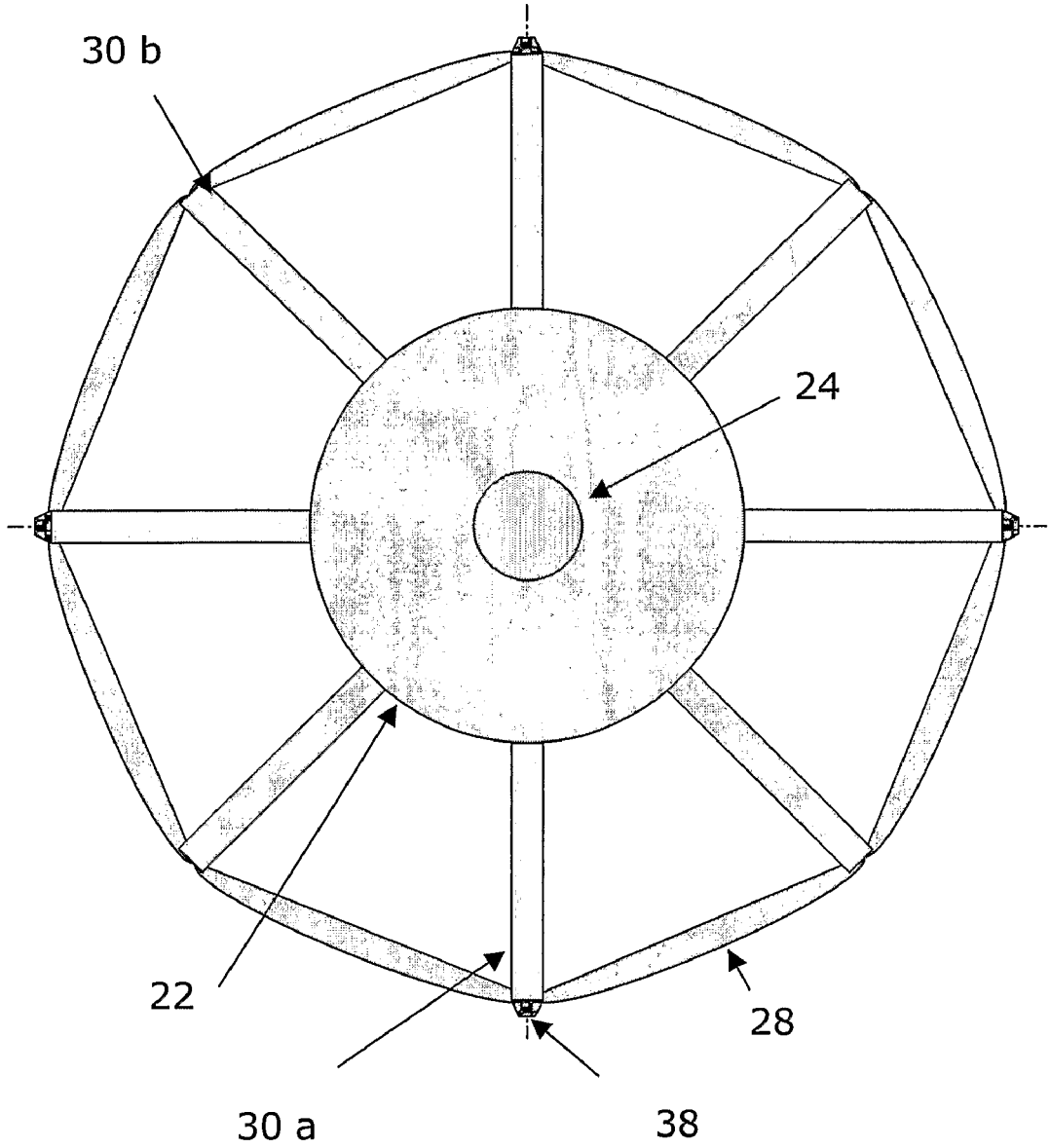
FIG. 3 shows a top view of the tool shown in FIG. 2.

A borehole tool of a type to which the present invention relates is shown generally in FIG. 1. The tool 10 includes an array of small survey electrodes (buttons) 14*a*-14*b* mounted on a conductive pad 16 that is pressed against the borehole wall 18. A current source is coupled to each button such that current flows out of each button 14 into the adjoining formation, perpendicular to the borehole wall 18 $E_1$, $E_2$. The current returns to an electrode (not shown) that is located at or near the surface, or on another part of the tool 10. The individual button currents are monitored and recorded (by an uphole processor 20) as the tool 10 is moved through the borehole. The measured button currents are proportional to the conductivity of the material in front of each button. The measurements allow identification of features such as fractures B from the images produced from the measurements.

A tool embodying the invention is shown in FIGS. 2-6 and comprises a tool mandrel 22 that is reduced in diameter to a slim tube 24 over the pad section 26. The pad section 26 with 2N pads 28 (in this case N=4) uses an even number 2N of support arms 30 to connect the pads 28 to either the mandrel 22 or a vertically sliding ring 32. A standard-size mandrel of may be 10 cm in diameter, but this is reduced to a very slim centre tube 24. This tube 24 must maintain the mechanical integrity of the tool string and thus have sufficient tensile and bending strength. The slim section 24 primarily serves as mechanical guiding rod for the deployment of the sensor pads 28. It may also contain in its center a wire harness (not shown) for through-wiring if other tools are to be run below the pad tool 10.

Figure 4:
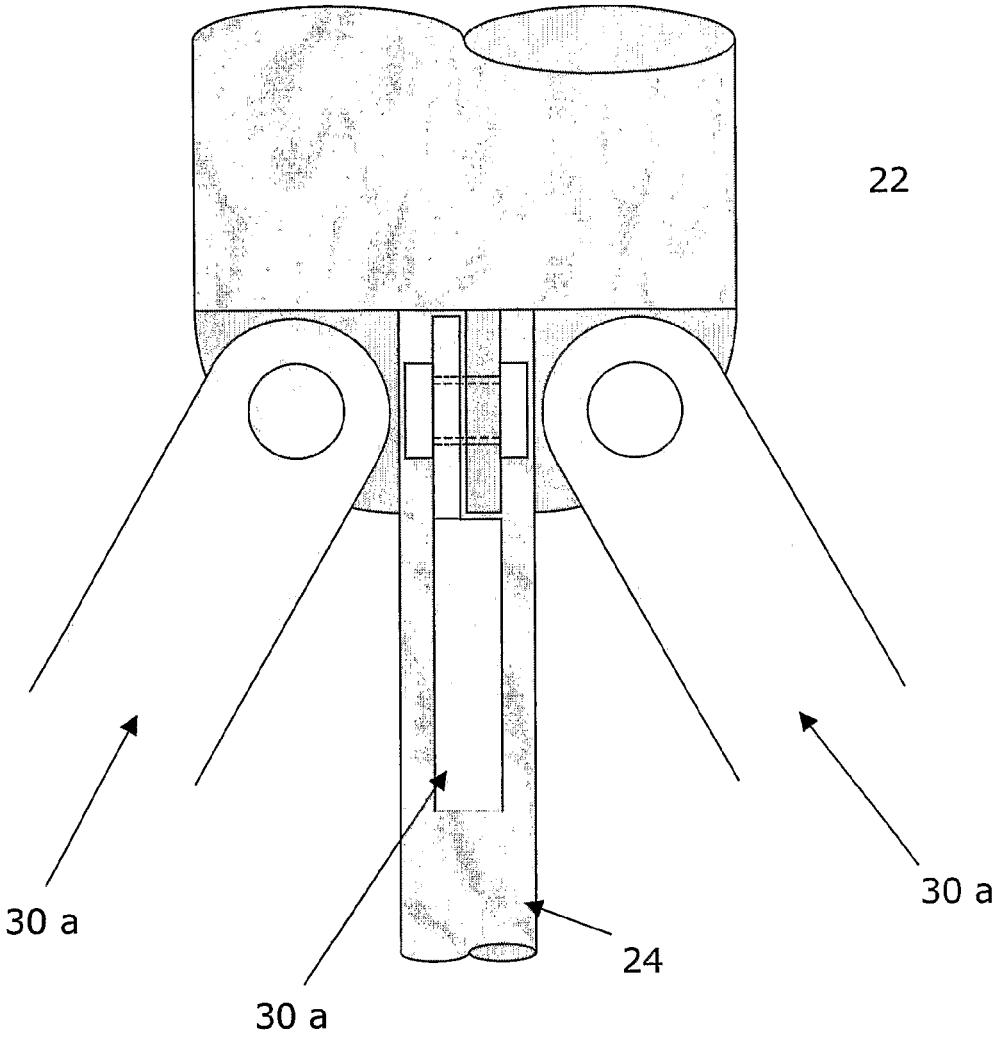
FIG. 4 shows a detailed side view of the upper arm attachment of the tool of FIG. 2.
Figure 5:
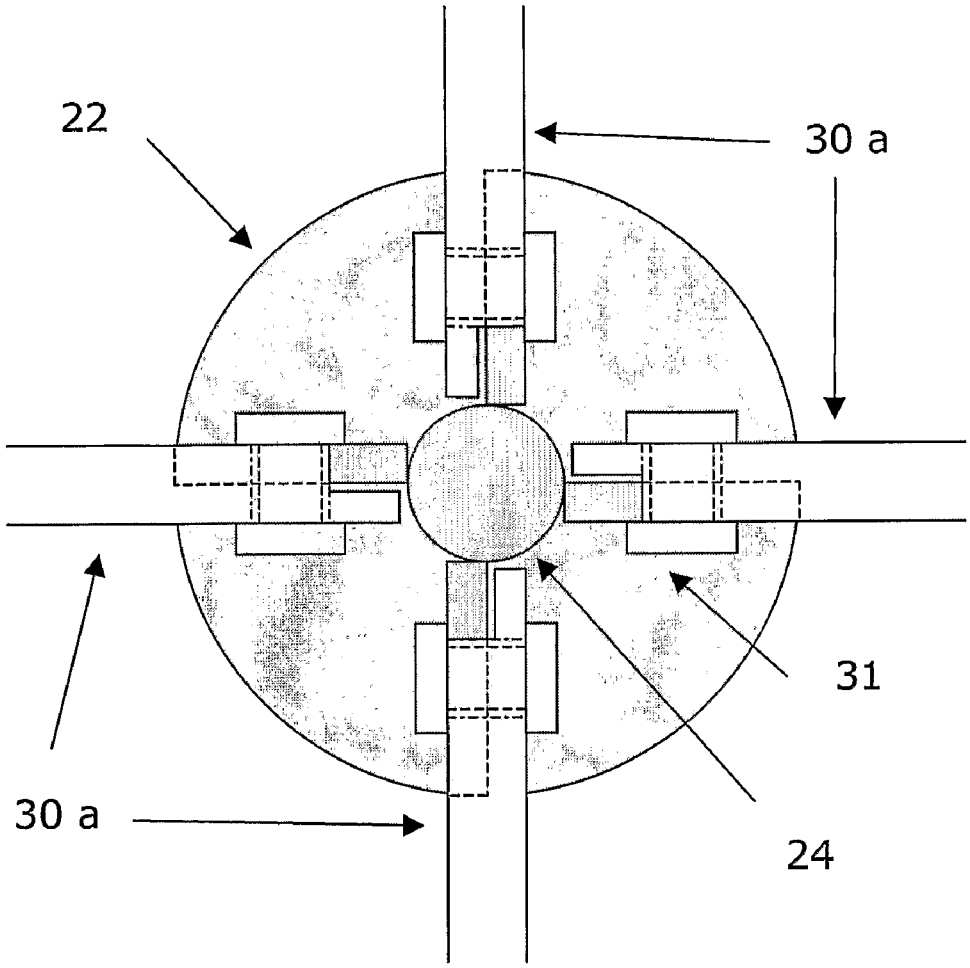
FIG. 5 shows a top view of the attachment shown in FIG. 4.

Half of the support arms 30*a* form an upper set and are attached to the top end of the slim section 24 and are evenly spaced at 360°/N (90°) around the perimeter of the tool to point in downward direction and be moveable radially outward from the pivot-attachment point 31 (shown in more detail in FIGS. 4 and 5).

The other half of the arms 30*b* form a lower set and are attached to a ring 32 that slides freely up and down the slim section 24. The arms 30*b* point in an upward direction and are moveable radially outward from a pivot attachment point 34 on the ring 32 similar to that shown in FIGS. 4 and 5. The arms 30*b* are also evenly distributed around the perimeter of the ring at 360°/N (90°). The N arms 30*b* of the lower set on the ring 32 are azimuthally offset from the arms 30*a* on the mandrel 24 by 180°/N (45°), which is half the angle between any two adjacent arms of a given set.

The arms 30 may be spring-loaded in such a way that they are pushed radially outward if they are not constrained otherwise (not shown in figures). Furthermore, the bearing of each arm 30 may contain a monitoring device (not shown in figures) that measures the angle between the arm 30 and the tool axis Z. These measurements are combined to give an N-axis (here four-axis) borehole calliper.

The tool has 2N (8) sensor pads 28. The pads 28 are narrow, elongated pads having a curved outer surface to accommodate the borehole-wall curvature; they may also be flexible to better fit against non-circular borehole-wall shapes. Each pad 28 is fixed to the end of one upper radial arm 30*a* and the end of an adjacent lower radial arm 30*b*. This way, each arm 30 supports two sensor pads 28. The chain of pads 28 extends accordion-style around the perimeter of the entire tool. As the radial arms 28 extend outwards, the sensor-pad accordion unfolds until it describes a full circle or until the borehole wall constrains the radial-arm deployment. By their deployment, each pad 28 covers 360°/2N (=45°), regardless of borehole size; the pads 28 are tilted against the orthogonal vertical-azimuthal borehole-wall coordinate system. The tilt angle depends on the borehole size, namely on the radial extension of the radial support arms 30.

The arms 30*a* attached to the top of the slim section 24 contain the wire harnesses (not shown) for the sensor pads 28 that are attached to them (not shown in figures). They are fed to the inside of the mandrel 22 in the immediate vicinity of the top mounting points 31. The lower set of arms 30*b* are attached to the sliding ring 32. The slim section of the mandrel 24 must be sufficiently long to accommodate the length of the upper and lower radial arms 30*a*, 30*b* and the full length of the sensor pads 28. These arm and pad lengths are predetermined according to the range of borehole sizes and ovalization in which the tool will be used. The sliding ring 32 is pushed upward by a suitable actuator (not shown) in order to force the ends of the arms 30 outwards and deploy the pads 28 against the borehole wall. The actuator can comprise a spring or electric or hydraulic motor, or any other suitable drive means. For downhole deployment, the ring 32 will be locked in place at its bottom position on the slim mandrel 24.

Figure 6:
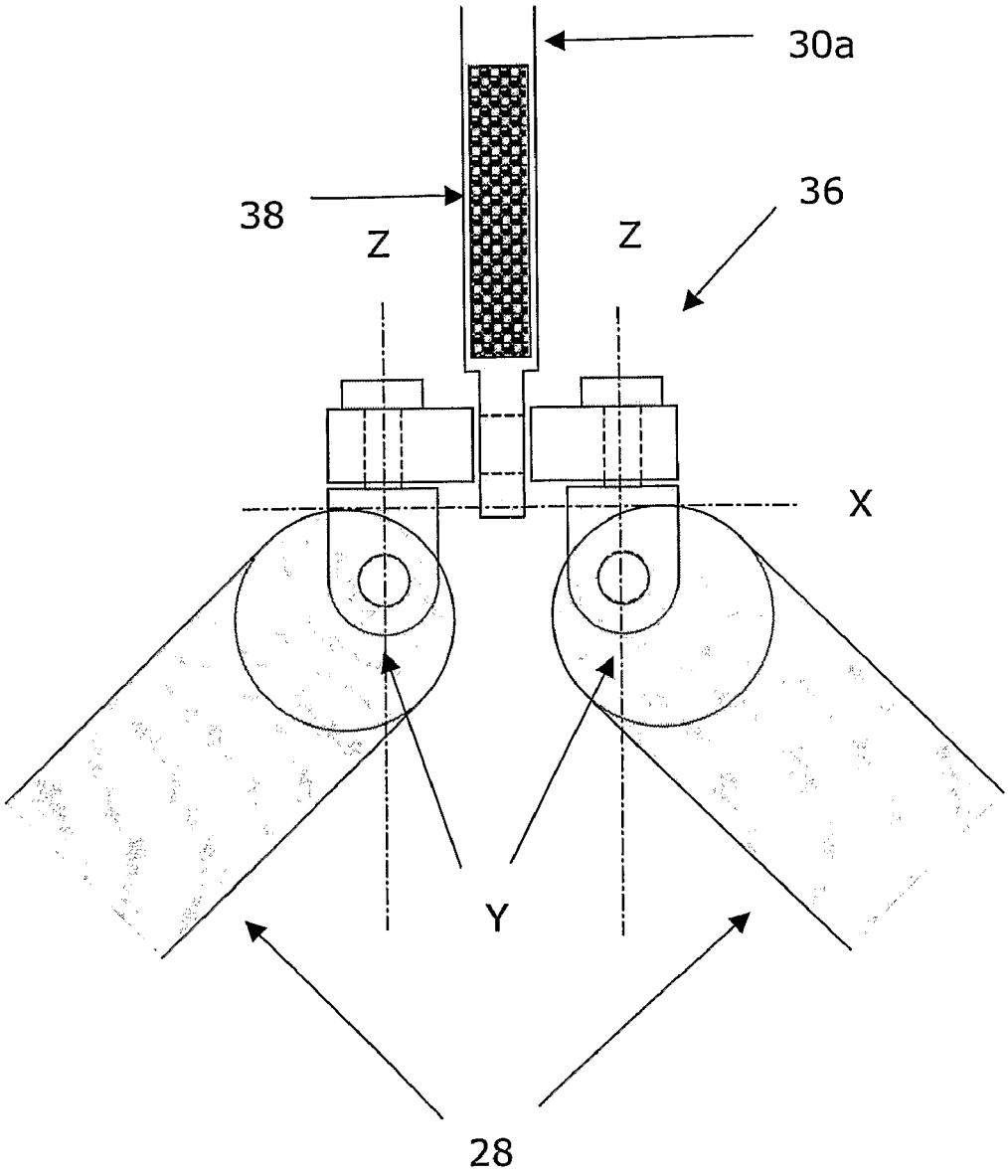
FIG. 6 shows a detailed view of the pad to arm connection for the tool of FIG. 2.

The sensor pads 28 are mounted on the arms 30 by means of freely rotating joints. FIG. 6 shows a three-axis joint that allows rotation about three distinct, orthogonal axes X, Y, Z but constrains the pad rotations into synchronous movements. Two adjacent pads 28 are arranged to rotate around one common axis X in a synchronous manner. The joints 36 are used in a closed loop that constrains the rotation of all pads 28 mutually with respect to each other. One axis X is common to two adjacent pads (FIG. 6). This common axis forces any two adjacent pads 28 to tilt off the borehole-wall surface in a synchronous manner. The entire chain of pads forms a closed loop in which all pads around the perimeter must follow any such synchronous tilting motion. This synchronous tilt renders the entire pad loop more rigid and less susceptible to unwanted tilting of any single pad face off the borehole wall. Thus, the design mechanically forces the pad faces to stay mutually aligned in outward-facing orientation, regardless of hole size or inclination. Alternately, a universal joint or some other type of skewed one- or two-axis rotation device may be used; however, any such alternative may not ensure the intrinsic rigidity of the closed pad loop against pad-tilt off the borehole wall.

The pad mount is shown in FIG. 6. It must permit the pads 28 to move freely as they spread around the hole perimeter between the radially spreading support arms. At the same time, the pad faces must be firmly oriented radially outward, avoiding any tilt against the borehole-wall surface as much as possible. The Z-axis rotations of all pads are independent. However, the X-rotation axis is shared by two adjacent pads. Thus, the tilt rotation of the said pad will be mechanically communicated to its neighbour pads.

The neighbour pads tilt with the same angle as the original pad. An X-rotation axis from an upper support arm 30 may support a tilt through an X-rotation by some angle $\theta$ and a Z-rotation by some angle $\phi$, tilting the two attached pad faces both downward and toward each other (where the angle $\phi$ is pointing in opposing directions for the two pads). Then the nearest-neighbour axes from the lower arms at the other end of the pads must rotate by the same angle $\theta$ following the downward tilt of the pad face. Here, however, the Z-angle $\phi$ is orienting the two faces away from each other. Successively, this tilt-rotation is communicated to the next pads beyond the nearest-neighbour pads through the X-rotation axis on the far side of the neighbour pads. This way, any tilt motion rigidly communicates around the entire pad loop.

A universal tilt motion is still possible, since the number of pads in the loop is even. This universal tilt will be controlled by the average of the applied forces on the entire pad loop. A suitable mechanical design of these forces will serve to ensure that on average this tilt is zero and that the pad faces are parallel to the borehole wall.

Figure 7:
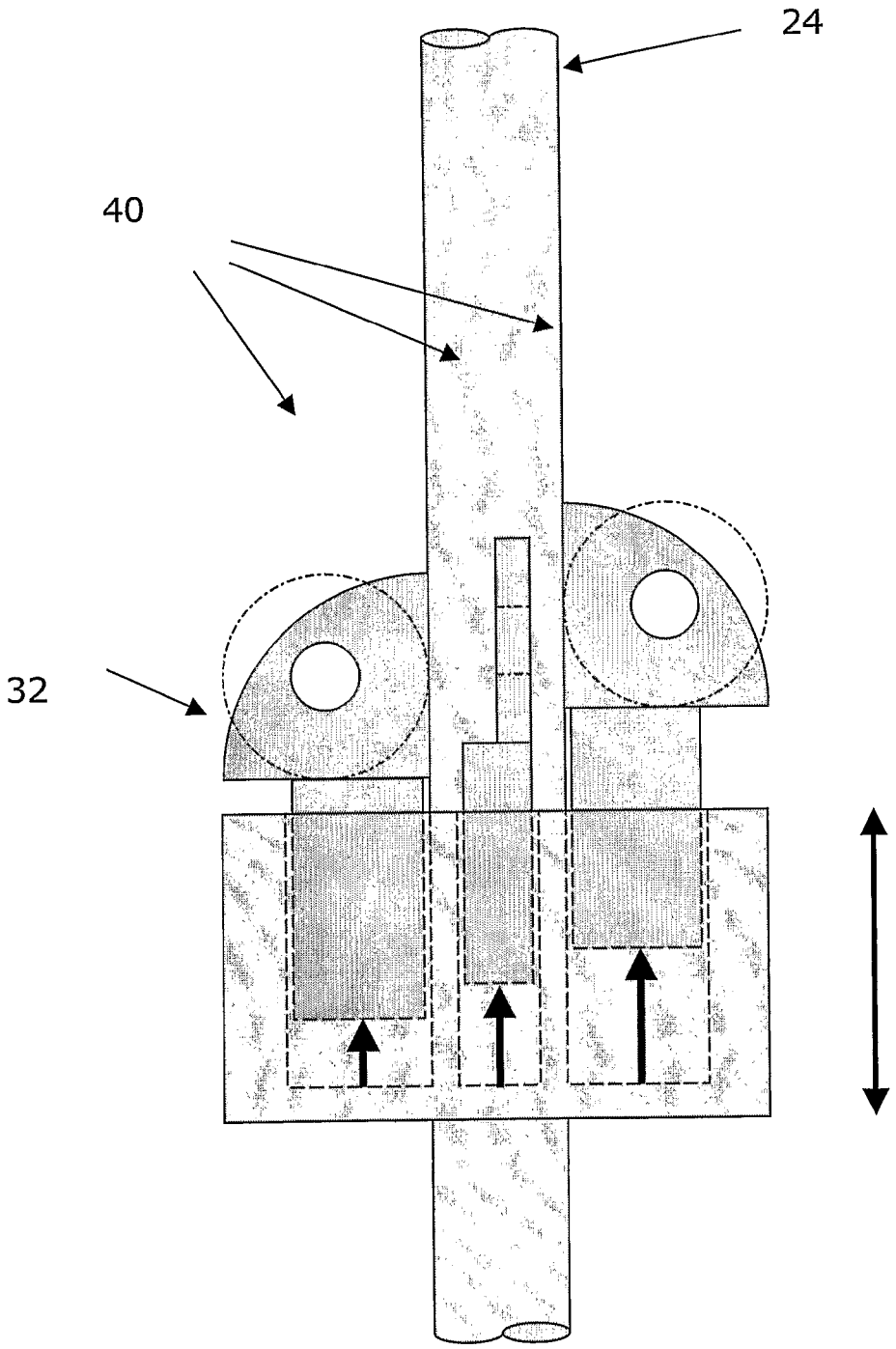
FIG. 7 shows an alternative embodiment of a lower arm attachment.

Variations can be made which provide more flexibility to the deployment or provide places to deploy additional measurement sensors. In one further embodiment as is shown in FIG. 7, the bearing 40 on the sliding ring 32 for each arm (omitted from FIG. 7 for clarity) is able to independently slide within the ring axially up or down over a limited range. This axial sliding action can be spring-controlled such that the ring (32) position is at the axial center of the various forces. The independently up-down sliding arm-bearings permit a pad deployment that extends beyond circular boreholes toward ovalized holes. The length of the axial-sliding freedom will determine the range of hole ovalization that can be supported.)

The arms of the tool 30 are pushed radially outward to the borehole wall and can be arranged to scrape the wall and so are provided with a hardened scraper plate 38 as an abrasion point. These scraper plates 38 can cut through the mud cake on the borehole wall and into the rock of the borehole wall itself. The point at the end of each arm may also be instrumented with a mm-resolution sensor, for example with a fluorescence-logging probe, an X-ray density probe or an infrared video-camera probe which can complement the measurement made via the pad.

A modification of the tool embodiments described above include a detector of the angle $\theta_{arm}$ between the tool axis and any single radial support arm. The known tool-body size $d_{tool}$ and support-arm length $l_{arm}$ then determine the radial distance $r_{arm}$ from the tool axis to the mechanical contact point with the borehole wall:

$$r_{arm} = \frac{1}{2}d_{tool} + l_{arm}\sin\theta_{arm} \tag{1}$$

Hence, each arm constitutes a half-calliper.

Half-callipers obtained in this way for tools in which the upper and lower arms are fixed axially to the tool body 24 or sliding ring 32 are a variation of standard callipers. At the same time, the calliper presented so far is limited to substantially circular holes due to the intrinsic rigidity of the assembly. The fact that the sliding ring 32 keeps all upward pointing arms at the same axial location as it slides up or down the tool body forces the closed pad chain into a circular ring without any ovalization.

In the embodiment of FIG. 7, the bearing of the upward-pointing radial arms within the sliding ring 32 is modified. The support points of these arms are able to move over a limited interval axially along the ring, even as the ring itself is axially sliding up or down the tool.

The axial ring position itself and the relative axial position of each arm within the ring are independently monitored and processed to provide separate measurements. Equation (1) gives for each arm the radial half-calliper. The axial ring position $z_{ring}$, measured from the top end of the sonde, and each axial arm position $\delta z_{arm}$, measured around the median value $z_{ring}$, are related to the half-calliper and thus provide an independent, complementary measurement to the radial angle $\theta_{arm}$.

$$z_{ring}=2l_{arm}\cos\theta_{ave}$$

$$z_{ring}+\delta z_{arm}=2l_{arm}\cos\theta_{arm} \tag{2}$$

This equation is solved for the radial angle $\theta_{arm}$ $$\theta_{arm} = \arccos\left(\frac{z_{ring} + \delta z_{arm}}{2l_{arm}}\right) \tag{3}$$

and then used in equation (1) to provide the half-calliper measurement:

$$\begin{aligned} r_{arm} &= \frac{1}{2}d_{tool} + l_{arm}\sin\left(\arccos\left(\frac{z_{ring} + \delta z_{arm}}{2l_{arm}}\right)\right) \\ &= \frac{1}{2}d_{tool} + \sqrt{l_{arm}^2 - \frac{1}{4}(z_{ring} + \delta z_{arm})^2} \end{aligned} \tag{4}$$

These equations, as written, are an approximation that only illustrates the operating principle. In elongated holes the actual angles are a more complex function of the axial positions $\delta z_{arm}$ for two adjacent arms.

While the embodiment of the invention described above shows a sensor pad tool, the invention applies to any borehole tool that requires pads to be applied to the borehole wall, especially where full circumferential coverage is required. Tools for well completion or remedial treatment may also embody this invention.

The invention claimed is:

1. A borehole tool, comprising: a tool body; a series of arms connected to the tool body and moveable radially relative thereto; and a series of pads mounted on the arms so as to be pivotable relative thereto; wherein the pads are pivotable about a radial axis relative to the tool body, and the pads are elongate pads adjacently arranged to provide different circumferential coverage according to the orientation with respect to the longitudinal axis of the borehole.

2. A tool as claimed in claim 1, wherein the pads are connected to the arms such that the orientation of the pads relative to the tool body is determined by the extent of the arms in the radial direction.

3. A tool as claimed in claim 2, wherein the pivoting of the pads is synchronized such that the pads adopt a substantially regular pattern of orientation.

4. A tool as claimed in claim 3, wherein adjacent said pads are interconnected so as to synchronize pivoting.

5. A tool as claimed in claim 1, wherein the pads are arranged in a ring, each pad being connected at its ends to the adjacent pads.

6. A tool as claimed in claim 1, wherein the arms are arranged symmetrically around the tool body.

7. A tool as claimed in claim 1, wherein each arm is connected to the tool body at one end by a pivot or hinge that allows the arm to move in a radial plane relative to the tool body.

8. A tool as claimed in claim 1, wherein the ends of the arms are to be connected to the pads.

9. A tool as claimed in claim 1, wherein the arms can move between two limit position: the first in which the arm lies substantially parallel to the tool body; and the second in which the arm projects away from the tool body in a radial direction to contact the borehole wall.

10. A tool as claimed in claim 1, wherein the series of arms comprises two sets of arms separated along the tool body with the series of pads encircling the body between the sets of arms.

11. A tool as claimed in claim 10, wherein the arms of each set extend from the connection on the tool body towards the other set.

12. A tool as claimed in claim 11, wherein the two sets of arms are arranged on the tool body in an angularly offset configuration.

13. A tool as claimed in claim 12, wherein the pads are connected to the arms in such a way that one end of one of the pads is connected to an arm from the first set and the other end of the pad is connected to the adjacent arm of the second set.

14. A tool as claimed in claim 10, wherein the ends of one set of arms are located in a fixed position on the tool body and the ends of the other set are located on the tool body by means of a sliding ring which can be driven along the tool body to cause the arms of both sets to extend or retract.

15. A tool as claimed in claim 14, further comprising a detector for detecting the angle between any arm and the tool axis.

16. The use of a tool as claimed in claim 15, to determine the size of a borehole in which it is positioned.

17. A tool as claimed in claim 15, wherein the location of the arms on the ring is provided so as to allow axial movement of the ends of the arms relative to the tool body.

18. The use of a tool as claimed in claim 17 to determine the size of a borehole in which it is positioned.

19. A tool as claimed in claim 14, wherein the location of the arms on the ring is provided so as to allow axial movement of the ends of the arms relative to the tool body.

20. A tool as claimed in claim 19, further comprising a detector for detecting the axial position of the ring and the location point of each arm.

21. The use of a tool as claimed in claim 19 to determine the shape of a hole in which it is positioned.

22. A tool as claimed in claim 1, wherein the pads form a zigzag array extending around the circumference of the borehole.

23. A tool as claimed in claim 22, wherein each arm is connected to two of said pads at adjacent ends.

* * * * *